US008720159B2

(12) United States Patent
Kobayashi et al.

(10) Patent No.: US 8,720,159 B2
(45) Date of Patent: May 13, 2014

(54) FLOOR CONSTRUCTION METHOD IN MACHINERY PRECEDING CONVEYANCE AREA IN BUILDING

(75) Inventors: Akihiko Kobayashi, Chiba (JP); Masahiro Nishizawa, Yokohama (JP); Takao Tokita, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 586 days.

(21) Appl. No.: 12/883,822

(22) Filed: Sep. 16, 2010

(65) Prior Publication Data

US 2011/0067352 A1 Mar. 24, 2011

(30) Foreign Application Priority Data

Sep. 17, 2009 (JP) ..... 2009-215663

(51) Int. Cl.
*E04B 1/35* (2006.01)
*E04B 1/343* (2006.01)
*E04H 14/00* (2006.01)

(52) U.S. Cl.
CPC . *E04B 1/35* (2013.01); *E04B 1/343* (2013.01); *E04H 14/00* (2013.01)
USPC ..... 52/745.05; 52/745.09; 52/745.12

(58) Field of Classification Search
CPC ..... E04B 1/35; E04B 1/00; E04B 5/00; E04B 1/343; E04B 14/00; E04H 14/00; E04H 1/00; E04H 1/06
USPC ..... 52/745.05, 745.09, 745.15, 745.01, 52/745.12, 745.06, 745.16
See application file for complete search history.

(56) References Cited

U.S. PATENT DOCUMENTS

| | | | | | |
|---|---|---|---|---|---|
| 1,409,729 | A | * | 3/1922 | Kennedy | 52/745.09 |
| 1,701,113 | A | * | 2/1929 | Keller | 264/33 |
| 2,379,636 | A | * | 7/1945 | Hedgren | 52/745.05 |
| 3,315,424 | A | * | 4/1967 | Smith | 52/206 |
| 3,398,491 | A | * | 8/1968 | Babcock | 52/90.1 |
| 3,659,388 | A | * | 5/1972 | Sirianni | 52/91.1 |
| 3,690,086 | A | * | 9/1972 | Cole et al. | 52/97 |
| 4,987,719 | A | * | 1/1991 | Goodson, Jr. | 52/742.14 |
| 5,337,533 | A | * | 8/1994 | Kajita | 52/741.1 |

(Continued)

FOREIGN PATENT DOCUMENTS

| | | |
|---|---|---|
| JP | 58-143296 | 8/1983 |
| JP | 2006-119842 | 5/2006 |
| JP | 2008-144513 | 6/2008 |

OTHER PUBLICATIONS

Office Action issued Nov. 8, 2010 in Japanese Application No. 2009-215663 filed Sep. 17, 2009.

*Primary Examiner* — Phi A
(74) *Attorney, Agent, or Firm* — Oblon, Spivak, McClelland, Maier & Neustadt, L.L.P.

(57) ABSTRACT

In a method of floor construction in a machinery preceding conveyance area of a building, such as a nuclear power plant, a floor of the building is divided into two work zones, floor and outer wall construction is performed in one of the work zones of the divided work zones of the floor as building work, preceding carry-in articles is installed in sequence as electric/mechanic equipment installing working, and partition wall construction which is building work is performed. In the other work zone, construction work of the floor and outer walls is performed as building working during the electric/mechanic equipment installing working in the aforementioned one of the divided work zone.

6 Claims, 8 Drawing Sheets

① FLOOR AND OUTER WALL CONSTRUCTION
② PRECEDING CONVEYANCE INTO WORK ZONE
③ PARTITION WALL SET CONSTRUCTION WITHIN WORK ZONE
④ CEILING CONSTRUCTION WITHIN WORK ZONE

(56) References Cited

U.S. PATENT DOCUMENTS

| | | | | |
|---|---|---|---|---|
| 5,526,628 | A * | 6/1996 | Knudson | 52/528 |
| 5,724,782 | A * | 3/1998 | Rice et al. | 52/745.05 |
| 6,122,888 | A * | 9/2000 | Bodnar | 52/745.05 |
| 6,584,740 | B2 * | 7/2003 | Record | 52/270 |
| 6,770,228 | B2 * | 8/2004 | Rock | 264/33 |
| 6,880,304 | B1 * | 4/2005 | Budge | 52/426 |
| 7,073,306 | B1 * | 7/2006 | Hagaman | 52/745.09 |
| 7,159,365 | B2 * | 1/2007 | Cohen | 52/245 |
| 2008/0127600 | A1 * | 6/2008 | Schiffmann et al. | 52/741.1 |
| 2008/0127602 | A1 * | 6/2008 | Schiffmann et al. | 52/741.11 |
| 2008/0155937 | A1 * | 7/2008 | Sontum | 52/741.15 |
| 2008/0244991 | A1 * | 10/2008 | Coleman et al. | 52/71 |
| 2009/0000242 | A1 * | 1/2009 | Waite et al. | 52/749.1 |
| 2009/0120028 | A1 * | 5/2009 | Guerra | 52/506.05 |
| 2009/0165401 | A1 * | 7/2009 | Smalley, III | 52/91.3 |
| 2010/0011677 | A1 * | 1/2010 | Kampanatsanyakorn | 52/90.1 |
| 2010/0043329 | A1 * | 2/2010 | Dagg | 52/414 |
| 2010/0088986 | A1 * | 4/2010 | Veerman et al. | 52/262 |
| 2010/0107520 | A1 * | 5/2010 | Lundmark et al. | 52/167.7 |
| 2010/0154323 | A1 * | 6/2010 | Ruland et al. | 52/126.6 |
| 2010/0263313 | A1 * | 10/2010 | MacDonald | 52/483.1 |
| 2011/0011018 | A1 * | 1/2011 | Johnson et al. | 52/223.11 |

* cited by examiner

① FLOOR AND OUTER WALL CONSTRUCTION
② PRECEDING CONVEYANCE INTO WORK ZONE
③ PARTITION WALL SET CONSTRUCTION WITHIN WORK ZONE
④ CEILING CONSTRUCTION WITHIN WORK ZONE

FLOOR CONSTRUCTION METHOD IN MACHINERY PRECEDING CONVEYANCE AREA IN BUILDING

CROSS-REFERENCE TO RELATED APPLICATION

This application is based upon and claims the benefit of priority from Japanese Patent Application No. 2009-215663, filed Sep. 17, 2009, the entire contents of which are incorporated herein by reference.

FIELD OF THE INVENTION

The present invention relates to a method of floor construction in a machinery preceding conveyance area (that is, an area into which machinery or equipment is conveyed or installed in advance) of a building, such as a nuclear power plant, aiming to reduce losses in process in electric/mechanic equipment arranging working and constructing or building working thereof, and shortening construction process and man-working hours.

RELATED ART

In the construction work of a building, such as a nuclear power plant, a working floor is divided into a plurality of zones (for example, ten work zones) to perform construction of outer walls, partition walls and the like, and then the floor construction for providing a machinery preceding conveyance area for equipment, pipes and the like to be carried into in advance is performed at the time of electric/mechanic machinery or equipment installing working (i.e., electric- and/or mechanic equipment setting working), building working and the like working of a reactor building.

In this case, floor and outer wall construction work is performed as construction provider's 9 or provider side) work of respective work zones on a floor. At the time of these items of work, in a conventional technology, it is necessary to carry out work coordination between an electric/mechanic equipment or machinery provider-side and a construction provider-side. Thus, the work and coordination have been repeatedly carried out for each work zone a plurality of times.

It is further to be noted that, herein, the term "electric/mechanic" as used herein in the phrases "electric/mechanic equipment provider-side (or provider)," "electric/mechanic working," and the like refers to "electric/mechanic (or electro- and/or mechanic) equipment. In contrast to building working which deals with the main body of a building, such as walls and floors, the working in which interior equipment is provided is referred to as "electric/mechanic equipment installing (setting out) work". In this context, this working may be simply rephrased as equipment or equipment installation working or work.

A conventional method of floor construction in a machinery preceding conveyance area in the construction work of a nuclear power plant will be described hereunder with reference to FIGS. 6 to 9.

FIG. 6 is a vertical cross-sectional view illustrating a schematic framework of an upper portion of a reactor building. As illustrated in FIG. 6, a reactor building 101 includes a floor 102 serving as a floor of a machinery preceding conveyance area, an outer wall 103 installed along the periphery of the floor 102, a partition wall 104 for dividing an inside space of the outer wall 103, and ceilings 105, 106 and 107 installed on upper ends of the outer wall 103 and the partition wall 104 so as to cover a space surrounded by the outer wall 103.

In addition, articles to be delivered in advance (preceding carry-in or conveyance articles) 108, 109 and 110 are carried and installed in a space on the floor 102 surrounded by the outer wall 103, the partition wall 104 and the ceilings 105, 106 and 107.

FIGS. 7A to 7D are plan views illustrating a construction procedure according to a conventional example, and FIGS. 8A to 8F are process drawings illustrating a work procedure. The outer wall 103 is quadrangular in plan view, and the article to be delivered in advance (which may be called preceding carry-in article(s) hereinafter) 108, 109 and 110 are carried in from, for example, one direction of the floor 102 (from the left side of FIG. 8).

As illustrated in FIGS. 7A and 8A, a reactor pressure vessel 100 is installed in the central position surrounded by the outer wall 103. Under this condition, partition walls 104*a* and 104*b* are constructed by a construction provider on the floor 102 of a working floor.

A preceding carry-in article 108 (such as a pump, a tank, a pipe, or a cable tray) is carried by an equipment provider into an area divided by these partition walls 104*a* and 104*b*.

Next, as illustrated in FIGS. 7B and 8B, a partial ceiling 105 is constructed above the preceding carry-in articles 108 by a construction provider, and then a preceding carry-in article 109 is carried in by the equipment provider.

After the preceding carry-in article 109 is carried in by the electric/mechanic equipment provider, partition walls 104*c* are installed between the outer wall 103 and the reactor pressure vessel 100 on the floor 102 by the construction provider, as illustrated in FIGS. 7C and 8C. After that, an article to be subsequently delivered 110 is carried into a space divided by the partition walls 104*c* by the equipment provider.

Further, thereafter, a ceiling 107 is set up by the construction provider in a position in which the article 110 subsequently carried onto the floor 102 is installed, as illustrated in FIGS. 7D and 8D to 8F.

An upper stage of FIG. 9 is an illustration representing processes (steps) of such a conventional construction method as described above.

As illustrated in this FIG. 9, in the conventional construction method, steps including: (1) floor and outer wall construction, (2) partition wall construction, (3) prior delivery, (4) ceiling construction, (5) prior delivery into the next area, (6) ceiling construction, (7) prior delivery into the next area, and (8) ceiling construction, are carried out in sequence. Thus, steps of constructing walls, partition walls, ceilings, and the like are overlapped.

As described above, in the conventional construction working of a nuclear power plant, construction by the equipment provider and construction by the construction provider are often switched to each other and, therefore, coordination is required in terms of construction. Consequently, process losses have been caused and man-hours of some of the steps have increased than previously planned, which may result in causing of a delay in a construction process in some cases.

Moreover, in the construction working of the nuclear power plant, the floor is divided into approximately 10 work zones and walls are constructed in sequence, and then, equipment, machinery, pipes and so on are previously carried in before the ceilings are constructed. However, process losses arise due to the construction coordination between the equipment provider and the construction provider each time the above-described procedure is followed. These losses may in some cases cause increased man-hours to partially exceed those previously planned, thus resulting in a delay in the construction process. These affairs have been one of causes for an increase in construction costs.

In nuclear power plant construction, it is urgent and important factors or tasks to reduce costs and shorten processing time, and thus, it becomes necessary to provide and establish a construction method of reducing process losses in electric/mechanic machinery or equipment arranging working, and building and constructing working, thereby achieving construction process shortening, man-hour reduction, and the like.

SUMMARY OF THE INVENTION

The present invention has been accomplished in view of such circumstances as described, and it is therefore an object of the present invention to provide a method of floor construction in a machinery preceding conveyance area, capable of reducing process losses due to construction coordination between equipment installing working and building constructing working to thereby shorten a construction process and man working-hours associated therewith by roughly dividing a floor work zone of the machinery preceding conveyance area into two zones and constructing walls and ceilings after prior delivery of machinery or equipment, thus leading to cost reductions in building construction work.

In a method of floor construction in a machinery preceding conveyance area of a building provided for achieving the above object of the present invention includes:

- dividing a floor of the building into two work zones;
- performing floor and outer wall construction in one work zone of the divided two work zones of the floor as a building working;
- installing preceding carry-in articles sequentially as an electric/mechanic equipment installing working;
- performing partition wall construction including a building working; and
- performing floor and outer wall construction in another work zone of the divided two work zones of the floor during the above-mentioned preceding electric/mechanic equipment installing working.

In the method of floor construction in a machinery preceding conveyance area of a building of the aspect mentioned above, it may be desired that the preceding carry-in articles are set out on a floor surface apart from the outer wall so as not to interfere with a scaffolding to be disposed along the outer wall, the preceding carry-in articles are carried into the floor after the construction of the floor and the outer wall, and then, the partition wall are constructed.

It may be also desired that the outer wall is formed of a prefabricated iron plate, or is formed as a PC wall structure.

In this embodiment, when the outer walls are formed as a PC structure, iron plates which are formworks are also used as walls without being removed after concrete casting. Since the iron plates are not removed even after concrete casting, it is possible not to construct any scaffolding for removing the iron plates. Thus, it is possible to locate preceding carry-in articles, such as pipes, in the vicinity of walls. Thus, it is possible to reduce process loss caused by moving the installation position of the pipes.

Still furthermore, in the above aspect of the present invention, it may be desired that during the preceding carry-in working in one work zone by the electric/mechanic equipment installation working, the floor and outer wall installation working in another work zone is completed to thereby continuously performing the preceding carry-in working by the electric/mechanic equipment working.

According to the present invention constituted as described above, it is possible to reduce the process loss due to the construction coordination between electric/mechanic equipment installing working and the building working by roughly dividing a floor of a machinery preceding conveyance area into two work zones and constructing walls and ceilings after the preceding conveyance of the electric or mechanic machinery or equipment. Thus, the construction process can be shortened and man-working hours associated therewith can be reduced. It is therefore possible to achieve cost reductions in the building construction working such as a nuclear power plant.

Since the amount of labor to coordinate between the equipment installation working and the building construction working can be reduced, the coordination work is reduced and the process loss is decreased as well.

In addition, the construction process is shortened as a result of the reductions in the process loss and the man-working hours associated therewith. Thus, a cost reduction involved in the building construction working is achieved.

The foregoing and other objects, features and advantages of the embodiments of the invention will become more apparent from the following detailed description taken in conjunction with the accompanying drawings. It should, however, be noted that the invention should not be interpreted as being limited to the embodiments described hereinbelow.

DESCRIPTION OF THE PREFERRED EMBODIMENT

Hereinafter, embodiments of a method of floor construction in a machinery preceding conveyance area of a building according to the present invention will be described with reference to the accompanying drawings, in which a nuclear power plant is taken as an example.

First Embodiment

Figure 1:
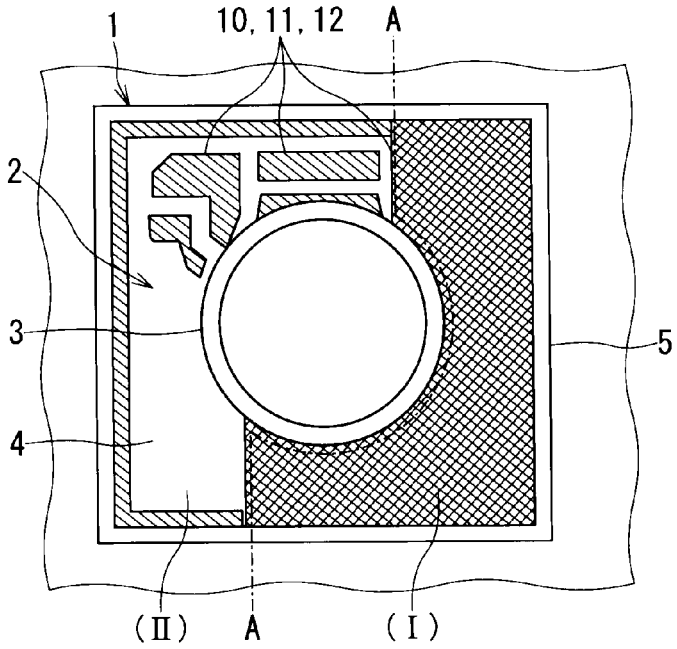
FIG. 1 is a plan view illustrating a construction area according to a first embodiment of the present invention.
Figure 2:
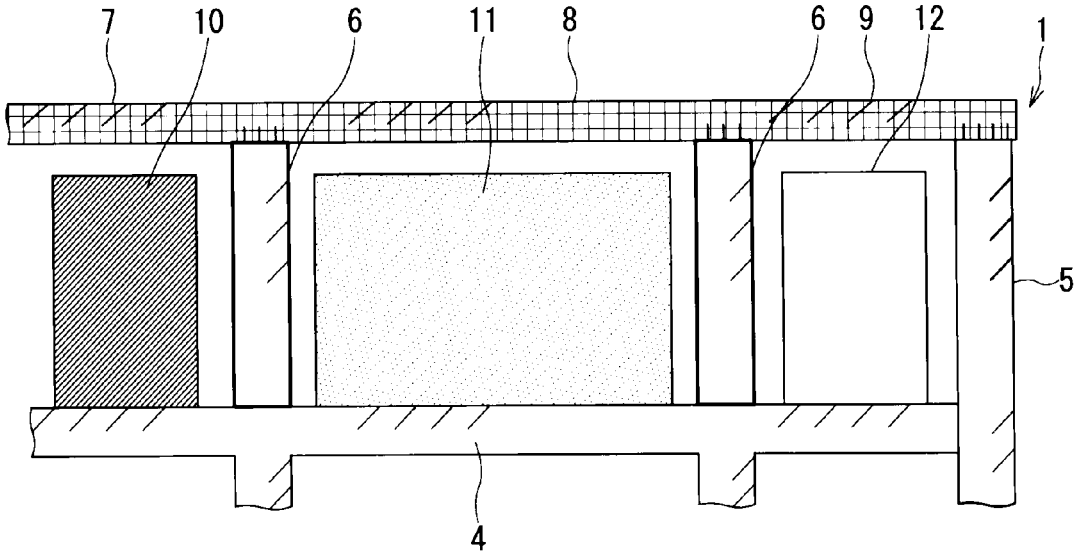
FIG. 2 is an enlarged cross-sectional view taken along the line A-A of FIG. 1.

FIGS. 1 to 3

FIG. 1 is a plan view illustrating the entire floor of a machinery preceding conveyance area (an area in which a machinery or equipment is preliminarily carried or delivered) in a nuclear power plant constructed by a floor construction method according to a first embodiment of the present invention. In FIG. 1, the machinery preceding conveyance area of the nuclear power plant, to which the construction method according to the present embodiment is applied, is illustrated.

That is, as illustrated in FIG. 1, a reactor pressure vessel 3 is located in a center position of a floor 2 of a reactor building 1 and the substantially rectangular working floor 2 is provided around this reactor pressure vessel 3. An outer wall 5 having a constant height is set up in the peripheral portion of the floor 2 so as to define the floor 2 therein.

With the reactor building 1 structured as described above in the present embodiment, the floor 2 of the reactor building 1 is divided at the center position in plan view, into two substantially equal working zones, as shown by a parting line denoted by the symbol A-A in FIG. 1, thereby dividing the floor 2 into a first work zone (I) and a second work zone (II).

Further, it is to be noted that FIGS. 1 and 2 illustrate a condition in which a ceiling 8 is set up above a floor area 4 of the working floor 2 of the first work zone (I), and articles 10, 11 and 12, which are carried or preceding carry-in inside the working zone (which may be called preceding carry-in articles 10, 11 and 12) such as equipments, components, and the like, are installed in the second work zone (II), and the present embodiment is intended to propose a floor construction method applied before this condition is taken.

FIG. 2 is a vertical cross-sectional view illustrating a schematic framework of an upper portion of a reactor building.

As illustrated in FIG. 2, a reactor building 1 includes a floor area 4 of a floor 2 serving as a machinery preceding conveyance area and an outer wall 5 set up so as to entirely cover the circumference of this floor area 4. A plurality of partition walls 6 formed of vertical plates for dividing an inner space of the partition walls 6 is installed in this outer wall 5. In addition, ceilings 7, 8 and 9 for covering an entire inner space surrounded by the outer wall 5 are constructed above the outer wall 5 and the partition walls 6.

In the present embodiment, the preceding carry-in articles 10 and 11 (such as pumps, tanks and piping modules) and a preceding carry-in article 12 (such as a pipe or a cable tray) are carried into and installed within respective spaces surround by the outer wall 5 and the partition walls 6 on the floor 2 after the partition walls 6 are installed on the floor 2. Thereafter, the ceilings 7, 8 and 9 are constructed.

The above-described construction process will be described more specifically with reference to FIGS. 1, 3A to 3D, and 4.

Figure 3A:
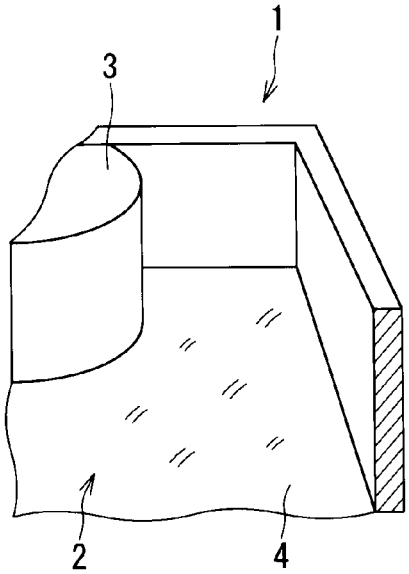
FIGS. 3A to 3D are perspective views specifically illustrating a construction procedure according to the first embodiment.

First, as illustrated in FIG. 1, a floor of the reactor building 1 is divided into two work zones, i.e., the first work zone (I) and the second work zone (II). Then, as illustrated in FIGS. 1, 3A and 4, construction of the floor area 4 and the outer wall 5 is performed as a construction provider-side work in the first work zone (I) which is one of the two divided work zones (floor and outer wall construction).

Figure 3B:
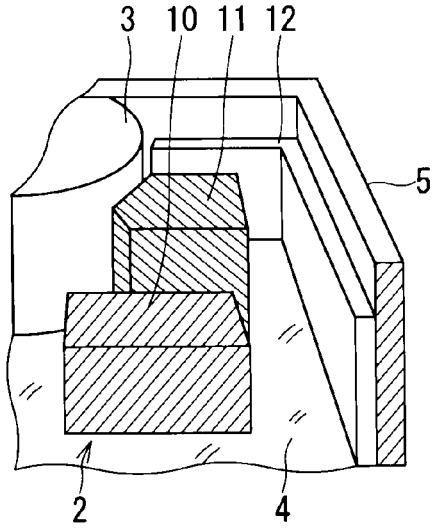
Figure 4:
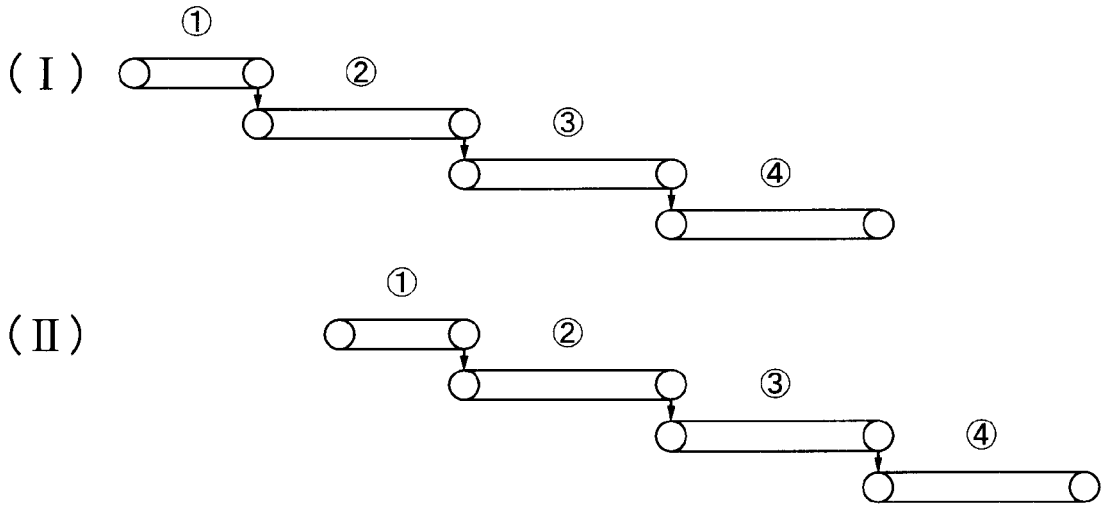
FIG. 4 is an illustration representing processes of a construction method according to the first embodiment of the present invention.

Next, as illustrated in FIGS. 1, 3B and 4, a plurality of the preceding carry-in articles 10, 11 and 12 is carried in and on the floor area 4 as the equipment provider-side work (prior delivery into work zones).

Figure 3C:
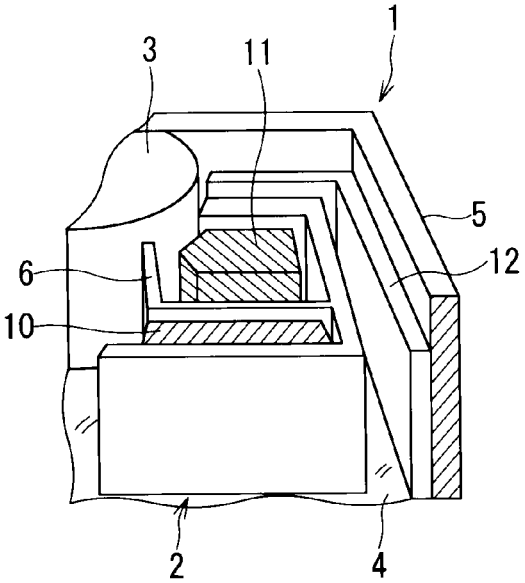

After this, as illustrated in FIGS. 1, 3C and 4, the construction of the partition walls 6 is performed as the construction provider-side work (partition wall installing working in the work zones).

Figure 3D:
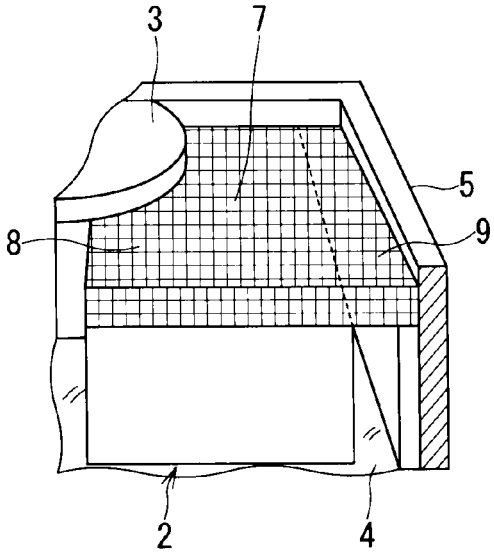

After the completion of construction of the partition walls 6, the ceilings 7, 8 and 9 are constructed as illustrated in FIGS. 1, 3D and 4 (ceiling construction working within the work zones).

At this time, the construction of the floor area 4 and the outer wall 5 is started as the construction provider-side work in the second work zone (FIG. 4(II)) which is the other work zone during the equipment provider-side work. Thus, the work similar to the one undertaken in one work zone is performed.

As described above, in the present embodiment, the floor area 4 of the reactor building 1 is divided into two work zones, and the construction of the floor area 4 and the outer wall 5 is performed as the construction provider-side work for one work zone (I) of the bisected floor area 4 (FIG. 4(I), step (1) of floor and outer wall construction).

Next, open-air placement of the preceding carry-in articles 10 and 11 (such as pumps, tanks, and piping modules) and the article 12 (such as a pipe or a cable tray) is performed in sequence as the equipment provider-side work (FIG. 4(I), step (2) of prior delivery into the work zones).

Thereafter, the construction of the partition walls 6 composed of a plurality of vertical walls is performed as the construction provider-side work to divide the machinery preceding conveyance area by these partition walls 6. After the completion of the construction of the partition walls 6, the ceilings 7, 8 and 9 are subsequently constructed, and concrete casting process, which is not illustrated, is collectively performed on the ceilings 7, 8 and 9 (FIG. 4(I), step (3) of partition wall set construction within the work zones).

During this construction in one work zone (I), the construction of the floor area 4 and the outer wall 5 is performed in the other work zone (II) as building construction working during the equipment provider-side work (FIG. 4(II), step (1) of floor and outer wall construction in the other work zone).

In this case, in the present embodiment, the preceding carry-in articles are previously installed and set out in a non-interfering manner, thus preventing the preceding carry-in articles 10, 11 and 12 and the outer wall 5 from interfering with each other. Under this installation, the articles 10, 11 and 12 are carried onto the floor 2 after the construction of the floor area 4 and the outer wall 5, and then, the partition walls 6 are constructed. Such a representation as "setting out the preceding carry-in articles so as not to interfere with the outer wall" as used herein means the placing of the articles such as pipes on a floor surface apart from the outer wall. The preceding carry-in articles are installed and set out in this way so as to prevent the articles from interfering with scaffoldings disposed along the outer wall.

According to the construction method of the present embodiment including the above-described steps, the labor of construction coordination between the electric/mechanic equipment setting work and the building constructing work can be reduced by roughly dividing a floor work zone on the floor area 4 of the machinery preceding conveyance area into two zones and constructing the partition walls 6 and the ceilings 7, 8 and 9 on the floor area 4 after the prior delivery of electric or mechanic machinery and/or equipment, i.e., the preceding carry-in articles 10, 11 and 12. Thus, it is possible to significantly reduce the process losses in comparison with a conventional method.

In addition, the construction process of the present embodiment can be shortened as the result of reduction in the process losses, and the man working-hours associated therewith can also be reduced. Thus, cost reductions in the construction work of a nuclear power plant can also be achieved.

Figure 9:
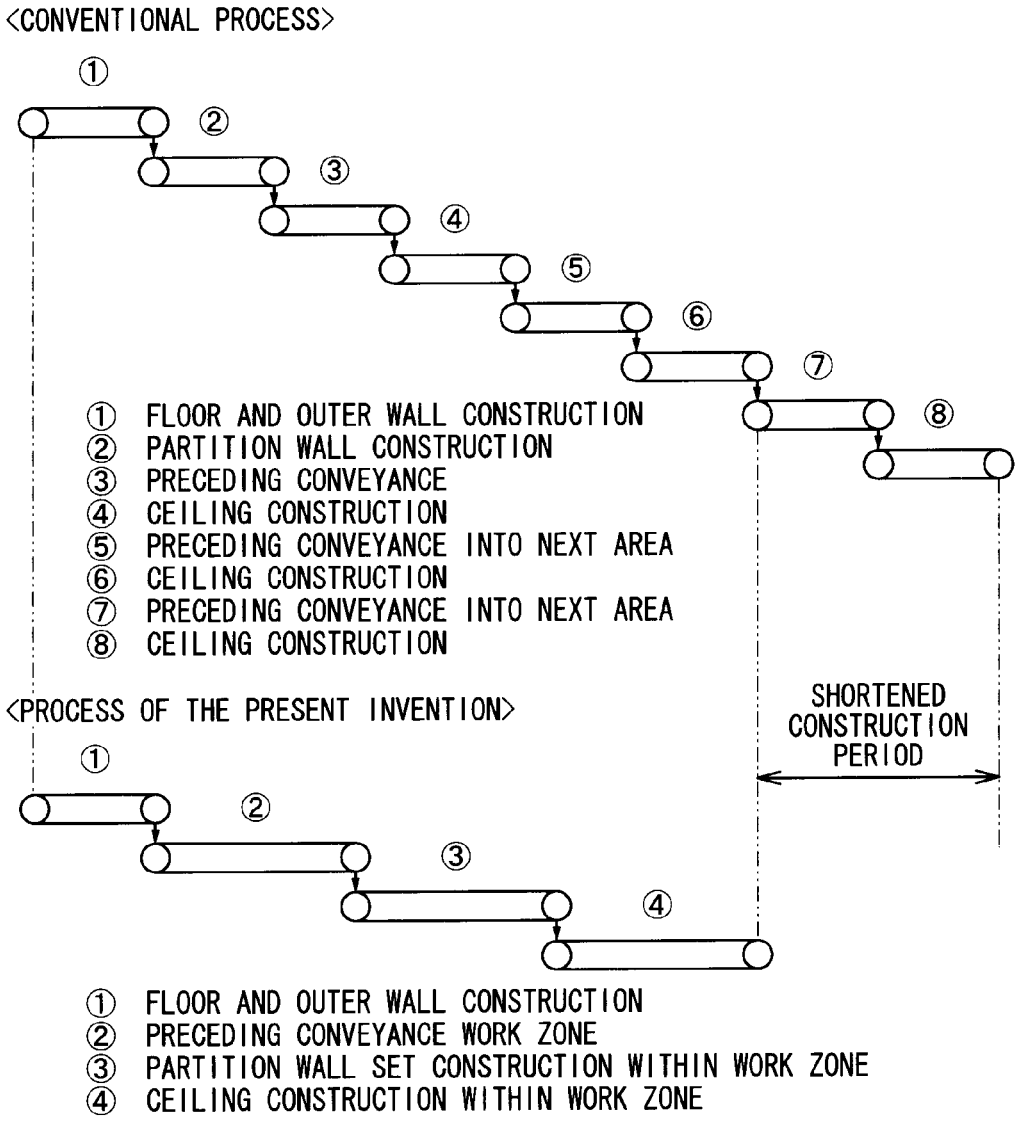
FIG. 9 is an illustration representing processes of construction methods of the conventional example and the present invention in contrast with each other.

As described above, according to the construction method of the present embodiment, the construction process is significantly simplified and overlapping steps in the working process are precluded, as shown by steps 1 to 4 (the floor and outer wall construction, prior delivery into work zones, partition wall set construction within the work zones, and the ceiling construction within the work zones) in FIG. 9. Consequently, it is possible to significantly reduce the process losses in comparison with conventional steps 1 to 8.

Second Embodiment

FIG. 5

Figure 5A:
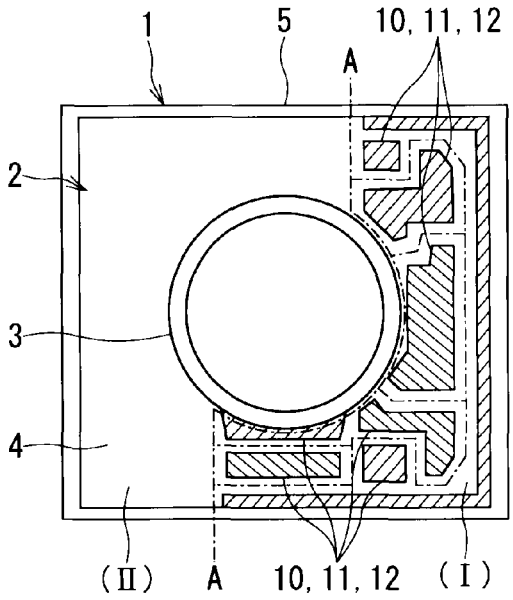
FIGS. 5A to 5C are transverse cross-sectional views illustrating a construction procedure according to a second embodiment of the present invention.
Figure 5B:
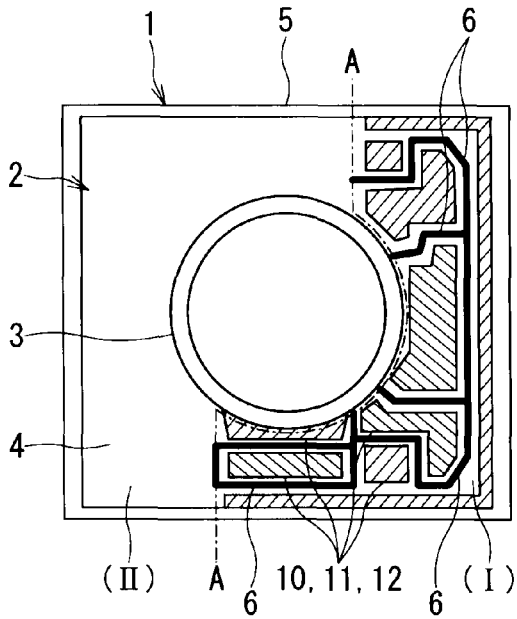
Figure 5C:
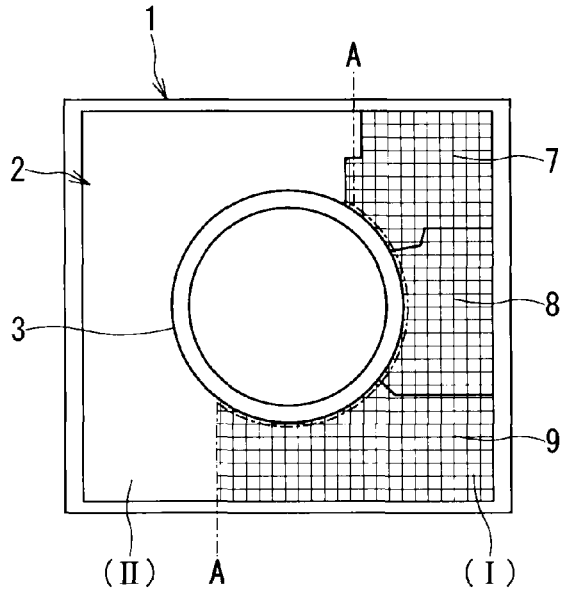
Figure 6:
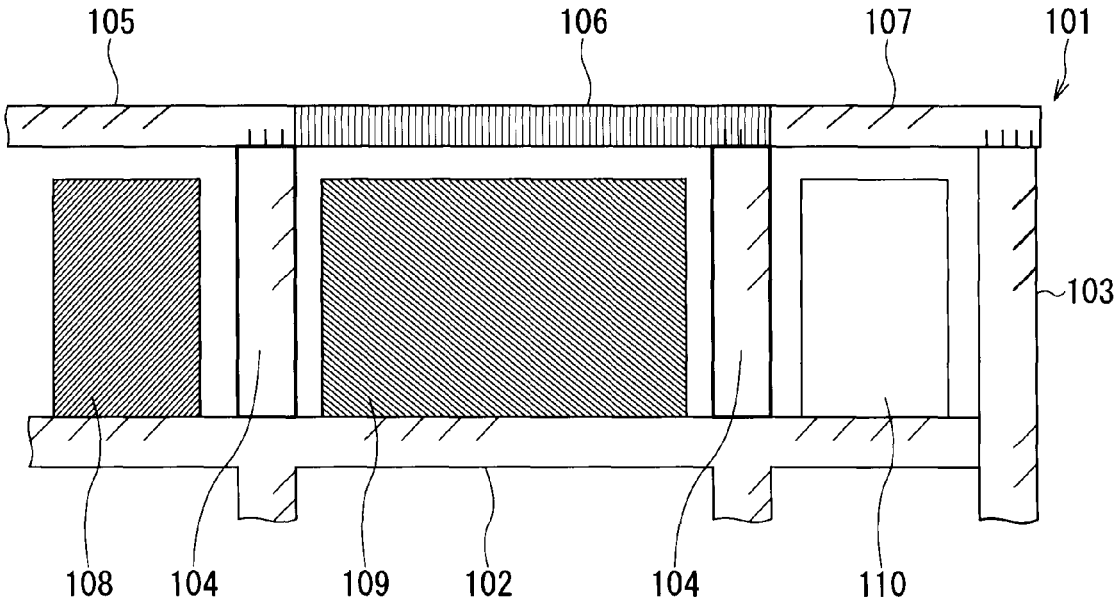
FIG. 6 PRIOR ART
FIG. 6 is a vertical cross-sectional view illustrating a layout example of an article preceding carry-in according to a conventional example.
Figure 7A:
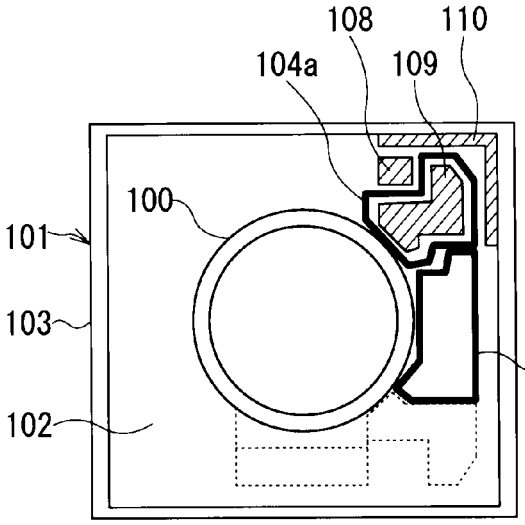
FIGS. 7A to 7D are plan views specifically illustrating a construction procedure according to the conventional example.
Figure 7B:
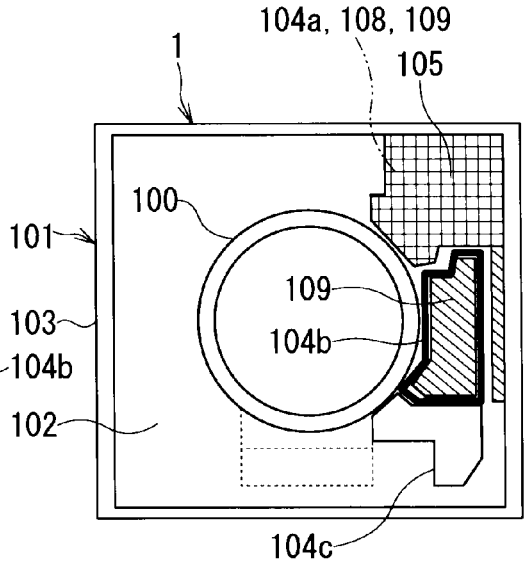
Figure 7C:
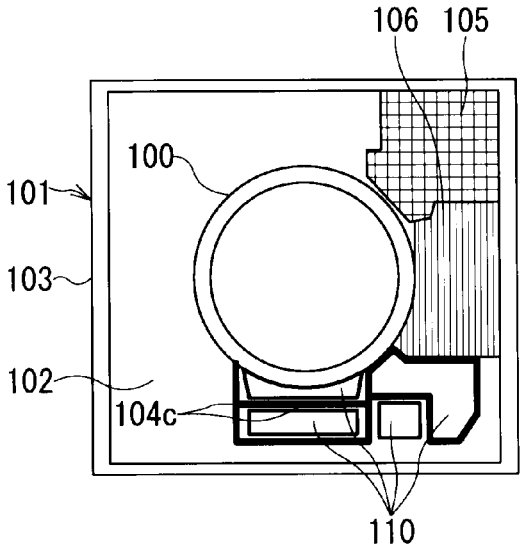
Figure 7D:
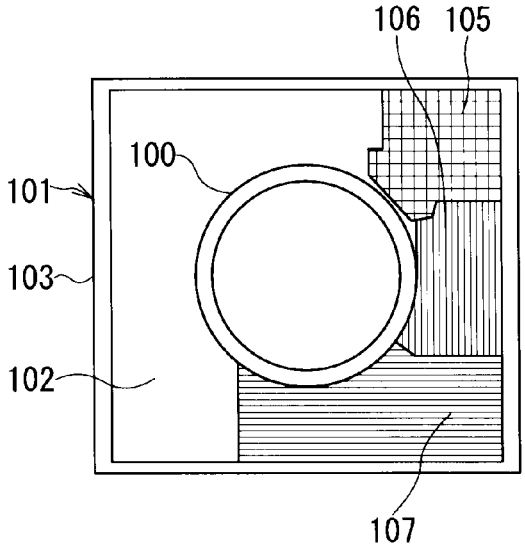
FIG. 7D PRIOR ART
Figure 8A:
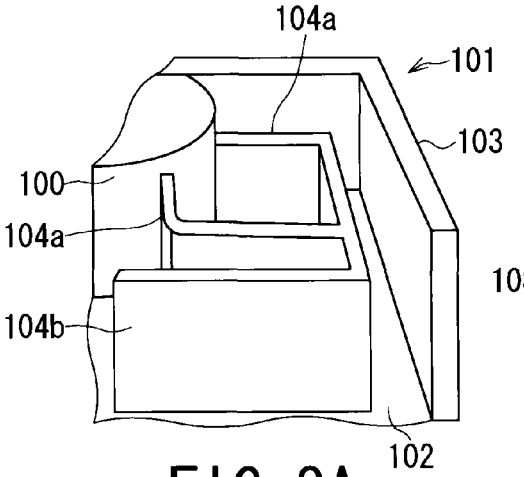
FIGS. 8A to 8F are illustrations sequentially showing processes of a construction method according to the conventional example.
Figure 8B:
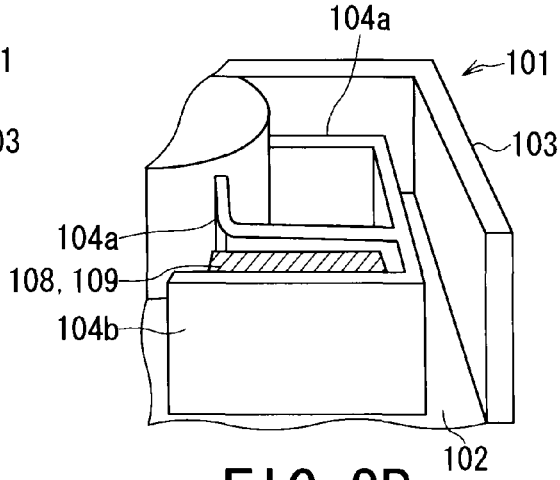
Figure 8C:
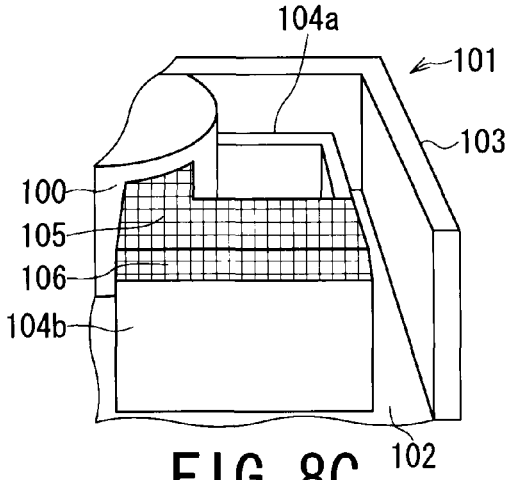
Figure 8D:
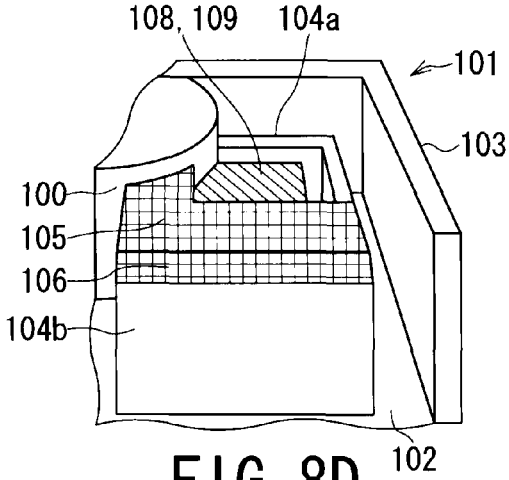
Figure 8E:
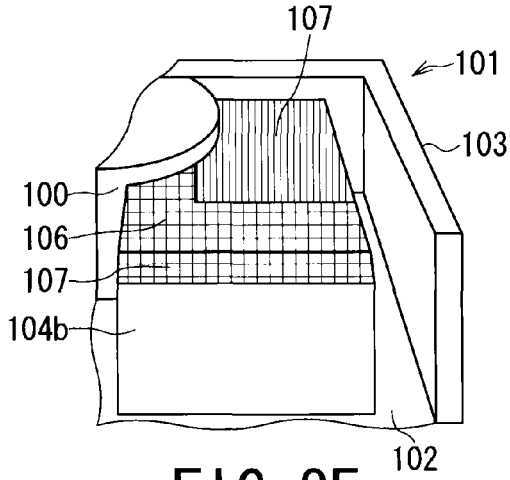
Figure 8F:
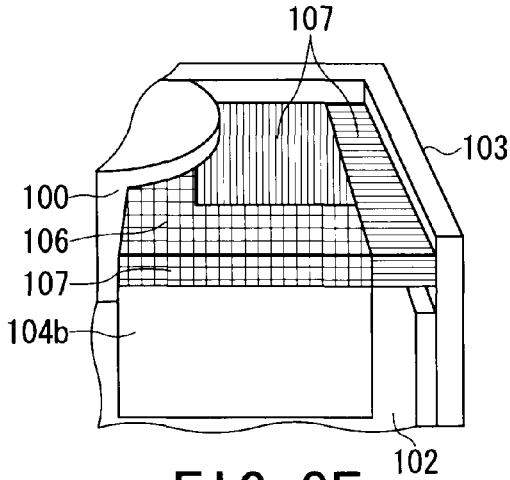
FIG. 8F PRIOR ART

FIGS. 5A to 5C are transverse cross-sectional views for the explanation of the construction process according to a second embodiment of the present invention.

The present second embodiment will provide a method of preventing process losses caused by setting a plan prior to the construction in the first embodiment.

As shown by a parting line denoted by the symbol A-A in FIG. 5A, a floor area 4 of a reactor building 1 is divided at the center position in the plan view, into two substantially equal work zones, thereby dividing the floor area 4 into a first work zone (I) and a second work zone (II).

Then, the construction of the floor area 4 and an outer wall 5 is performed as a construction provider-side work in the first work zone (I) of the bisected floor area 4, the placement of the preceding carry-in articles 10, 11 and 12 is performed in sequence as an equipment provider-side work, and the construction of the partition walls 6, which is the construction provider-side work, is performed. After the completion of the partition wall construction, the ceilings 7, 8 and 9 are subsequently constructed and concrete casting work is performed collectively.

In this case, in the second work zone (II), work is performed on the floor area 4 and the outer wall 5 as the construction provider-side work during the equipment provider-side work which is the construction in the first work zone (I).

According to the structure mentioned above, the carry-in working to the preceding carry-in articles 10, 11 and 12 and the construction of the floor 4, the outer wall 5*b* and the like can be prevented from interfering with each other. After the construction of the floor 4 and the outer wall 5, the preceding carry-in articles 10, 11 and 12 are carried onto the floor 4, and thereafter, the partition walls 6 are constructed.

According to the present embodiment in which such planning prior to construction as described above is carried out, the preceding carry-in articles 10, 11 and 12 and the outer wall 5 are set out at a planning phase so as not to interfere with each other. By carrying the preceding carry-in article 10, 11 and 12 onto the floor 4 after the construction of the floor 4 and the outer wall 5 and then constructing the partition walls 6, it is possible to reduce the labor of construction coordination between the electric/mechanic equipment installing working and building working, thereby reducing the process loss in comparison with a conventional method.

In addition, the construction process can be shortened as a result of reduction in the process loss, and man-working hours associated therewith can also be reduced. Thus, cost reductions in the construction work of a nuclear power plant can also be achieved.

Further, it is to be noted that in the present embodiment, the outer wall 5 may be formed of a prefabricated iron plate wall or a PC wall structure. The prefabricated iron plate and the PC wall, even with thin structure, can retain adequate strength.

As described above, in the present embodiment, a distance of the outer wall from the preceding carry-in articles 10, 11 and 12 may be decided at the planning phase so as to construct the partition walls 6 without being interfered, by carrying in the preceding carry-in articles 10, 11 and 12 and then constructing the partition walls 6 after the construction of the floor and the outer wall. In addition, the partition wall may be formed of a prefabricated iron plate wall or a PC wall structure in order to minimize a distance between each article and each partition wall 6. Thus, it is possible to prevent the process loss due to interference.

In the present embodiment, it is also possible to set out the preceding carry-in articles 10, 11 and 12 and the outer wall 5 so as not to interfere with each other, to carry in the preceding carry-in articles onto the floor 4 after the construction of the floor 4 and the outer wall 5, and then to construct the partition walls 6.

It is also possible to reduce a distance between the outer wall 5 and each partition wall 6, thereby preventing the process loss due to the interference between the outer wall 5 and each partition wall 6.

It is further preferable to complete the construction of the floor 4 and the outer wall 5 in another working zone during the preceding carry-in working by the equipment provider-side in one working zone and to perform the preceding carry-in working by the equipment provider-side continuously in the other work zone.

In the present invention, the preceding carry-in working by the floor construction in the machinery preceding conveyance area, which is the equipment provider-side working, may be performed, and then the construction work of the partition walls 6 and ceilings 7, 8 and 9 which is the construction provider-side subsequent working may be performed. Construction of another side of the floor 4, the outer wall 5, and the like may be completed during the preceding carry-in work which is the equipment provider-side work so as to continuously carry out the preceding carry-in working. Therefore, the working efficiency is promoted and the construction process is shortened by reducing or eliminating the process loss as described above.

Third Embodiment

As described above, in a conventional method, a floor is divided into a plurality of work zones and, after partition walls 6 are constructed, equipment is delivered (carried in) in advance before the ceiling construction is performed. Thus, the construction coordination between an electric/mechanic equipment provider-side and a construction provider-side is performed each time when the above-described procedure is followed. Consequently, the process loss is caused as a result of work and coordination being repeated several times for each work zone.

In contrast, in the present embodiment, the floor construction of a machinery preceding conveyance area is carried out in the manner that the process of the floor construction is integrated into four steps including: floor and outer wall construction; preceding carry-in work into work zones; partition wall set construction within work zones; and ceiling construction within work zones, as illustrated in FIG. 4. Accordingly, the each working process can be itself shortened.

In addition, the preceding carry-in working on the equipment provider-side working is performed and then the construction work of partition walls and ceilings on the construction provider-side working is subsequently performed. According to the present embodiment, the construction of another side of a floor and an outer wall can be completed during the work of the preceding carry-in working on the equipment provider-side working in one side working area, so that the preceding carry-in working can be carried out continuously. Thus, the working efficiency is promoted and the process loss is significantly reduced or eliminated, thereby enabling the construction process to be shortened.

Furthermore, in the above-described embodiments, a description has been made with reference to a building of a nuclear power plant as an example, the present invention is not limited to these embodiments and it is of course applicable to other similar buildings, and thus, many other changes and modifications may be made without departing from the scopes of the appended claims.

What is claimed is:

1. A method of floor construction in a machinery preceding conveyance area of a building, comprising:

dividing a floor of the building into two work zones; and performing constructing workings and electric/mechanic equipment installing workings alternately and parallelly in the divided first and second work zones, including:

performing floor and outer wall construction in the first work zone of the divided two work zones of the floor as a building working;

installing preceding carry-in articles sequentially as an electric/mechanic equipment installing working in the first work zone, and performing simultaneously floor and outer wall constructions in the second work zone of the divided two work zones during the installing of the preceding carry-in article in the first work zone;

performing partition wall construction including a building working in the first working zone, and installing simultaneously preceding carry-in articles sequentially as an electric/mechanic equipment installing working in the second work zone during the partition wall constructions in the first work zone;

performing subsequently ceiling construction of the first work zone after the completion of the partition wall construction and concrete casting working collectively, and performing wall construction including a building working in the second work zone during the ceiling construction of the first working zone; and performing subsequently ceiling construction of the second working zone after the completion of the partition wall construction and concrete casting working collectively.

2. The method of floor construction in a machinery preceding conveyance area of a building according to claim 1, wherein the preceding carry-in articles are set out on a floor surface apart from the outer wall so as not to interfere with a scaffolding to be disposed along the outer wall, the preceding carry-in articles are carried into the floor after the construction of the floor and the outer wall, and then, the partition wall are constructed.

3. The method of floor construction in a machinery preceding conveyance area of a building according to claim 1, wherein the outer wall is formed of a prefabricated iron plate.

4. The method of floor construction in a machinery preceding conveyance area of a building according to claim 1, wherein the outer wall is formed as a PC wall structure.

5. The method of floor construction in a machinery preceding conveyance area of a building according to claim 1, wherein during the preceding carry-in working in one first work zone by the electric/mechanic equipment installation working, the floor and outer wall installation working in another work zone is completed to thereby continuously performing the preceding carry-in working by the electric/mechanic equipment working.

6. A method of construction of a building, comprising:

performing a building working step including floor and outer wall construction in a work zone;

performing an electric/mechanic installing step including installing carry-in articles in the work zone, after the building working step;

performing a partition wall construction step including partition wall construction in the working zone, after the electric/mechanic installing step; and performing a ceiling construction and concrete casting step including ceiling construction of the work zone and concrete casting working, after the partition wall construction step, wherein the work zone is divided into at least first and second work zones, the building working step, the electric/mechanic installing step, the partition wall construction step and the ceiling construction and concrete casting step are performed in both of the first and the second working zones, respectively, wherein the building working step of the second work zone is performed during one of the electric/mechanic installing step, the partition wall construction step and the ceiling construction and concrete casting step of the first work zone.

* * * * *